United States Patent [19]

Vassiliou

[11] 4,259,375

[45] Mar. 31, 1981

[54] DECORATIVE PROCESS

[75] Inventor: Eustathios Vassiliou, Newark, Del.

[73] Assignee: E. I. Du Pont de Nemours and Company, Wilmington, Del.

[21] Appl. No.: 44,075

[22] Filed: May 31, 1979

[51] Int. Cl.[3] ..... B05D 5/06; B05D 1/36

[52] U.S. Cl. ..... 427/267; 427/258; 427/269

[58] Field of Search ..... 427/267, 268, 258, 269; 428/204, 205

[56] References Cited

U.S. PATENT DOCUMENTS 177,332 5/1876 Harris ..... 427/267

FOREIGN PATENT DOCUMENTS 942120 11/1963 United Kingdom ..... 427/267

956128 4/1964 United Kingdom ..... 427/268

*Primary Examiner*—Evan K. Lawrence

[57] ABSTRACT

A smooth heat-stable coating including a decorative pattern is applied to a substrate by applying and drying a primer coat and then applying, wet-on-wet, a base coat, an intermediate coat in the form of a decorative pattern, and a topcoat, then heating to dry the base, intermediate and topcoats simultaneously and to cure the entire coating.

Each coat includes an aqueous carrier. The primer, base coat and topcoat include a heat-stable polymer stable at temperatures above 300° C., preferably polytetrafluoroethylene.

5 Claims, No Drawings

DECORATIVE PROCESS

BACKGROUND OF THE INVENTION

Decorative patterns can be formed in heat-stable coatings by using patterns of catalysts or antioxidants to enhance or retard the decomposition of colorants such as carbon black or carbonaceous residues. These heat-stable coatings contain one or more heat-stable polymers which are polymers not affected by temperatures above 300° C. that would decompose, oxidize or otherwise adversely affect most organic compounds. Examples of this technology are found in applicant's U.S. Pat. Nos. 4,120,608 (Oct. 17, 1978) and 4,122,226 (Oct. 24, 1978).

Heat-stable coatings are widely used in applications such as nonstick coatings for cookware. See U.S. Pat. Nos. 4,087,394—Concannon (May 2, 1978) and 4,123,401—Berghmans and Vary (Oct. 31, 1978).

Each of the above-mentioned patents is incorporated herein by reference.

It is known to apply fluorocarbon coats on wet primer coats and cure the two coats simultaneously. U.S. Pat. No. 3,103,446—FitzSimmons (1963).

In addition to prior technology, it is desirable to be able to make smooth heat-stable coatings with decorative patterns formed by a colorant which has some thickness.

SUMMARY OF THE INVENTION

The present invention provides a process of applying to a substrate a smooth heat-stable coating including a decorative pattern, which process consists essentially of the sequential steps of (a) applying directly to said substrate a primer coat including aqueous liquid carrier and a heat-stable polymer composition stable at temperatures above 300° C. and removing any liquid carrier from said primer coat, (b) applying to said primer coated substrate a base coat composition including aqueous liquid carrier and a heat-stable polymer composition stable at temperatures above 300° C., (c) while the base coat still contains liquid carrier, applying to said base coat a decorative pattern of an intermediate coat composition including aqueous liquid carrier and a colorant-which produces a darkness or color differing from that of the base coat, (d) while the intermediate coat still contains liquid carrier, applying to said intermediate coat a light-transmitting topcoat composition including aqueous liquid carrier and heat-stable polymer stable at temperatures above 300° C., and (e) heating the coated substrate to drive off the liquid carrier and cure the coats to form a smooth, heat-stable coating.

The heat-stable polymer composition of the primer, base coat and topcoat comprises at least one material from the group consisting of a silicone, a polysulfide, a polymerized parahydroxy benzoic acid, a polysulfone, a polyimide, a salt of a polyamic acid, a polysulfonate, a polysulfonamide, a fluorocarbon, or mixtures thereof. The fluorocarbon is preferably at least one material selected from the group consisting of a particulate polymer polymerized or copolymerized from monomers selected from one or more monoethylenically unsaturated hydrocarbon monomers and hydrocarbon ether monomers, said monomers being completely substituted with fluorine atoms or a combination of fluorine atoms and chlorine atoms.

DETAILED DESCRIPTION

The primer coat applied first is one which maximizes adhesion to the substrate. The primar coat preferably is dried to remove liquid carrier. Then a base coat is applied. The color of the base coat is important, since it will be visible through the clear topcoat and the patterned intermediate coat. A colorant in the intermediate coat differing from or contrasting with the darkness or color of the base coat is used to create a decorative pattern. A patterned intermediate coat of discrete thickness can be accommodated by the invention. By applying the intermediate and topcoats wet-on-wet and drying and curing them and the base coat simultaneously, a smooth coating can be obtained. This is particularly important in cookware applications so that there will be no raised edges to be caught and torn by a cooking tool such as a fork or a spatula. Also, such edges could hold food particles and interfere with ease of cleaning of the cookware.

Generally, decorative patterns containing pigments, carbon black, carbonaceous residue or precursors of carbonaceous residues will have a discrete thickness and can benefit particularly from the invention. The decorative patterns could be predetermined or random, such as in a spattered form.

As an example, the compositions of U.S. Pat. No. 4,049,863—Vassiliou (1977) can be used to give a primer coat containing an aqueous dispersion of fluorocarbon polymer, colloidal silica, mica, and the salt of a polyamic acid. The primer is dried preferably by mild heating to remove the liquid carrier. Then a base coat is applied, such as the topcoat composition of U.S. Pat. No. 4,118,537—Vary and Vassiliou (Oct. 3, 1978), containing fluorocarbon polymer and a decomposable polymer, to which $TiO_2$ pigment is added for whiteness. A patterned intermediate coat can then be applied wet-on-wet in the form of a decorative pattern such as by spraying a discontinuous spattered pattern or spraying through a stencil. The intermediate coat can have the same composition as the base coat with added pigments of the desired colors. Then a light-transmitting topcoat, such as disclosed in U.S. Pat. No. 4,118,537, is applied and the whole system heated simultaneously to drive off the liquid carrier and to cure the coating. Using an aqueous PTFE dispersion as the heat-stable polymer, along with acrylics in the topcoat and polyamide-imides in the primer, the heating can be done effectively by slowly increasing the temperature to drive off the water, and heating to temperatures in the range of 350°-500° C., preferably 425° C., for a sufficient time at temperature to cure the coating, such as 3-5 minutes. Preferably, an oven is used which is calibrated to give the desired temperature by directly measuring the surface temperature of the substrate, such as with a thermocouple. The resulting coating is heat-stable to temperatures above 300° C., is smooth, and includes a decorative pattern.

What is claimed is:

1. A process of applying to a substrate a smooth, heat-stable coating in aqueous liquid carrier, said coating including a decorative pattern, which process consists essentially of the sequential steps of (a) applying directly to said substrate a primer coat including aqueous liquid carrier and a heat-stable polymer composition stable at temperatures above 300° C. and removing the liquid carrier from said primer coat, (b) applying to said primer coated substrate a base coat composition including aqueous liquid carrier and a heat-stable polymer composition stable at temperatures above 300° C., (c) while the base coat still contains the liquid carrier, applying to said base coat a decorative pattern of an intermediate coat composition including aqueous liquid carrier and a colorant which produces a darkness or color differing from that of the base coat, (d) while the intermediate coat still contains the liquid carrier, applying to said intermediate coat a light-transmitting topcoat composition including aqueous liquid carrier and a heat-stable polymer composition stable at temperatures above 300° C., and (e) heating the coated substrate to drive off the liquid carrier and cure the coats to form a smooth, heat-stable coating.

2. The process of claim 1 wherein the colorant of the intermediate coat composition includes pigments.

3. The process of claim 1 wherein the colorant of the intermediate coat comprises a material selected from the group consisting of carbon black, carbonaceous residue, carbonaceous residue precursor, or mixtures thereof.

4. The process of claim 1 wherein the heat-stable polymer of the primer, base coat and the topcoat comprises at least one material selected from the group consisting of a silicone, a polysulfide, a polymerized parahydroxy benzoic acid, a polysulfone, a polyimide, a salt of a polyamic acid, a polysulfonate, a polysulfonamide, a fluorocarbon, or mixtures thereof.

5. The process of claim 4 wherein the fluorocarbon of the primer, base coat and the topcoat comprises at least one material selected from the group consisting of a particulate polymer polymerized or copolymerized from monomers selected from one or more monoethylenically unsaturated hydrocarbon monomers and hydrocarbon ether monomers, said monomers being completely substituted with fluorine atoms or a combination of fluorine atoms and chlorine atoms.

* * * * *